US010064441B1

(12) United States Patent
Provencher

(10) Patent No.: US 10,064,441 B1
(45) Date of Patent: Sep. 4, 2018

(54) LOCKING BUTTON SYSTEM

(71) Applicant: Samuel David Provencher, Waltham, MA (US)

(72) Inventor: Samuel David Provencher, Waltham, MA (US)

(73) Assignee: Boston Inventions, LLC, Waltham, MA (US)

( * ) Notice: Subject to any disclaimer, the term of this patent is extended or adjusted under 35 U.S.C. 154(b) by 0 days.

(21) Appl. No.: 15/429,567

(22) Filed: Feb. 10, 2017

Related U.S. Application Data

(60) Provisional application No. 62/294,425, filed on Feb. 12, 2016, provisional application No. 62/295,195, filed on Feb. 15, 2016.

(51) Int. Cl.
*A41F 1/00* (2006.01)
*A44B 17/00* (2006.01)

(52) U.S. Cl.
CPC ..... *A41F 1/002* (2013.01); *A44B 17/0041* (2013.01)

(58) Field of Classification Search
CPC ..... A41F 1/002; A44B 17/0041
See application file for complete search history.

(56) References Cited

U.S. PATENT DOCUMENTS 2,895,199 A * 7/1959 Jones ..... A44B 17/0029 24/618
3,141,216 A * 7/1964 Haskell ..... A41F 1/002 24/303
3,195,201 A * 7/1965 Ash, II ..... A44B 17/0029 24/689
3,372,443 A * 3/1968 Daddona, Jr. ..... A41F 1/002 24/303
3,783,477 A * 1/1974 Hamilton ..... A44B 17/0029 24/622
4,021,891 A * 5/1977 Morita ..... A45C 13/1069 24/303
4,346,507 A * 8/1982 Heuck ..... A44B 1/06 29/243.519
4,562,624 A * 1/1986 Kanzaka ..... A44B 17/0029 24/621
5,722,126 A * 3/1998 Reiter ..... A41F 1/002 24/303
5,933,929 A * 8/1999 Kawakami ..... A44B 17/0035 24/324
6,182,336 B1 * 2/2001 Bauer ..... A41F 1/002 24/303
6,199,248 B1 * 3/2001 Akashi ..... A41H 37/001 24/114.6

(Continued)

*Primary Examiner* — David M Upchurch
(74) *Attorney, Agent, or Firm* — Ascentage Patent Law, LLC; Travis Lee Johnson; David S. Einfeldt

(57) ABSTRACT

Contemplated herein is a locking button system which includes a male component having a flange portion and a male locking pin provided on an upper surface of the flange portion. The system also includes a female component having an annular retention ring defining an interior cavity, the annular retention ring having an interior groove provided on the interior surface, the interior cavity having a diameter corresponding to an outer circumference of the flange portion of the male component, an axially telescoping cap, and a second locking pin provided on an interior surface of the axially telescoping cap.

12 Claims, 15 Drawing Sheets

(56) References Cited

U.S. PATENT DOCUMENTS

| | | | | |
|---|---|---|---|---|
| 6,295,702 | B1 * | 10/2001 | Bauer | A45C 13/1069 24/303 |
| 6,477,749 | B1 * | 11/2002 | Reiter | A41F 1/002 24/303 |
| 6,569,564 | B1 * | 5/2003 | Lane | H01M 2/0222 429/129 |
| 8,069,538 | B2 * | 12/2011 | Wilcox | A43B 3/0078 119/858 |
| 8,752,252 | B2 * | 6/2014 | Ninomiya | H01F 7/0263 24/303 |
| 9,307,806 | B1 * | 4/2016 | Dorman | A44B 1/14 |
| 2007/0143969 | A1 * | 6/2007 | Takamura | A44B 1/08 24/113 R |
| 2009/0056082 | A1 * | 3/2009 | Quimod | A44B 1/04 241/113 R |
| 2011/0041295 | A1 * | 2/2011 | Reiter | A44B 17/0011 24/303 |
| 2011/0047759 | A1 * | 3/2011 | Reiter | A44B 17/0023 24/303 |
| 2011/0140474 | A1 * | 6/2011 | Smith | B60R 13/0206 296/35.1 |
| 2012/0066874 | A1 * | 3/2012 | LeCompte | A44B 17/0005 24/304 |
| 2013/0074296 | A1 * | 3/2013 | Richardson | F16B 21/073 24/634 |
| 2013/0305497 | A1 * | 11/2013 | Coman | B62D 27/06 24/303 |
| 2015/0257494 | A1 * | 9/2015 | Oakley | A44B 17/0082 273/157 R |
| 2016/0135550 | A1 * | 5/2016 | Drage | A44B 17/0076 24/453 |
| 2016/0309820 | A1 * | 10/2016 | Bolen | A44B 1/08 |

* cited by examiner

Separated

Alignment

Engaged

Engaged and Locked angle 0°

LOCKING BUTTON SYSTEM

PRIORITY CLAIMS

This application claims the benefit of United States provisional patent application Nos. 62/294,425 being filed on Feb. 12, 2016, and 62/295,195 being filed on Feb. 15, 2016, each of which are hereby incorporated by reference in their entirety.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The disclosure relates to clasps, straps, buttons, snaps, and other easily removable fastening systems often used in clothing or other technologies involving fastening of one thing to another.

2. Description of the Prior Art

Present button type clasps involve the user of a mushroomed male portion and a female receiver wherein the female receiver has a portion wherein the female receiver has spring portions which deform elastically around the mushroomed head of the male portion so as to cause an interference fit between the mushroomed upper flange portion of the male portion and an interior portion of the female receiver.

The present invention seeks to overcome many deficiencies present in the prior art by providing a hybrid fastening system which has both mechanical and magnetic components operating in tandem to ensure a quick and easy, but also secure, coupling between a first and second component. It will be appreciated that the embodiments shown include the use of first and second components as they relate to the closure of a wrist portion of a glove, however, as will be appreciated by those having skill in the art, that the present embodiment can be used to replace, hook and loop, button, snap, buckles or any number of fasteners in any number of implementations from clothing to straps in commercial and household applications.

Unfortunately such buttons rely on the elastic properties of the materials or internal springs during clasping and release, which interference fit is unsuitable for many high tension situations as with buttons that are releasable through tension alone. Additionally these components can also become worn over time and get significantly weaker with age; thus, greatly diminishing their clasp strength.

BRIEF SUMMARY OF THE INVENTION

In order to provide a connector which overcomes various discussed limitations in the prior art which provides a strong and stable connection between two components, but is operable using a single hand. Additionally, the locking button system of the present invention is unaffected by dampness or immersion in water and can be made from non-corrosive materials for high-stress or heavy duty applications. As such, the present invention as contemplated herein can include a locking button system, the system having a male component having a male flange portion, the male component further including a first locking component being provided on an upper surface of the male component. The male component being configured to interact with a female component, the female component including an annular retention ring defining an interior cavity, the annular retention ring having an interior channel provided on an interior surface of the annular retention ring, the annular retention ring having a female flange portion having an inner diameter corresponding to an outer circumference of the male flange portion of the male component.

A cap can then be provided over the annular retention ring wherein a second locking component can be provided on an interior surface of the cap, the second locking component being configured to engage the first locking component of the male component.

In some embodiments, a magnet can be provided about an upper surface of the annular retention ring; and the cap can be formed of a magnetically responsive material such that the magnet and the cap are biased in a compressed configuration, or configured such that the cap and the magnet tend to draw together. In some alternative embodiments, a magnet can be provided on an upper surface of the annular retention ring; wherein the cap includes a corresponding magnet on an interior surface such that the magnet and the cap are biased in a compressed configuration, or configured such that the cap and the magnet tend to draw together. In yet another embodiment a magnet can be provided about an interior surface of the cap wherein the annular retention ring is formed of a magnetically responsive material such that the magnet and the cap are biased in a compressed configuration, or configured such that the cap and the magnet tend to draw together.

It will also be appreciated that in some embodiments the male component can include a base portion having an anchor means configured to attach to a first closing component, i.e. a first end of a strap. Further, in some embodiments the female component can also include a base portion having an anchor means configured to attach to a second closing component, i.e. a second end of a strap, such that two ends of a strap can be affixed together.

In some alternative embodiments, the magnet can be provided within a recess of an upper flange of the annular retainer ring such that an upper surface of the magnet is flush with the upper surface of the annular retainer ring.

In yet additional embodiments the magnet can be provided with an aperture about a central portion thereof, wherein the aperture has a radius corresponding with a depth of the interior channel of the annular retention ring.

In yet additional embodiments the cap can also be provided with an interior flange, and the annular retention ring further can be provided with an exterior flange, and wherein the cap is configured to translate axially with respect to the annular retention ring wherein the interior flange of the cap and the exterior flange of the annular retention ring interferingly engage with one another in an extended state and limit travel in the axial direction.

Also contemplated herein is a method for coupling a male component of a locking button system to a female component of locking button system, the method including the steps of: providing a male component having a male flange portion and a male locking pin provided on an upper surface of the male component; providing a female component, the female component having: an annular retention ring defining an interior cavity, the annular retention ring having an interior groove provided on the interior surface, the interior cavity having a diameter corresponding to an outer circumference of the flange portion of the male component; an axially telescoping cap; and a second locking pin provided on an interior surface of the axially telescoping cap; inserting the male component into the female component translating the male component axially until the male locking pin abuts against the second locking pin and thus causing the axially telescoping cap to translate axially; translating the male component radially outward causing the male flange portion to engage a sidewall of the interior groove; translating the axially telescoping cap so as to cause the second locking pin to interfere with radial translation of the male locking pin of the male component.

The method contemplated above can alternatively include the steps of providing a magnet on an upper surface of the annular retention ring; and forming the axially telescoping cap of a magnetically responsive material.

In yet another alternative embodiment, the method contemplated above can include the steps of: providing a magnet on an upper surface of the annular retention ring; and providing a corresponding magnet on an interior surface of the axially telescoping cap.

In some such alternative embodiments, the method can include a step of embedding magnet into a recess provided about an upper flange of the annular retainer ring such that an upper surface of the magnet is flush with the upper surface of the annular retainer ring.

In yet another alternative embodiment, the method contemplated above can include the steps of: providing a magnet on an upper surface of the annular retention ring; and providing an additional magnet on an interior surface of the axially telescoping cap.

In yet another alternative embodiment, the method contemplated above can include the steps of: embedding a magnet within an upper surface of the annular retention ring; and providing an additional magnet on an interior surface of the axially telescoping cap.

In yet another alternative embodiment, the method contemplated above can include the steps of: providing a magnet on an inner surface of the axially telescoping cap; and forming the annular retention ring of a magnetically responsive material.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION

To provide an overall understanding of the systems, devices, and methods described herein, certain illustrative embodiments will be described. Although the embodiments and features described herein are frequently described for use in clothing applications, it will be understood that all the components, mechanisms, systems, methods, and other features outlined below can be combined with one another in any suitable manner and can be adapted and applied to other similar systems and in any number of suitable settings.

The present application seeks to provide a solution to the aforementioned problems, namely reduce the correlation between clasp strength and material resilience and mere tension of an interference fit. This is achieved by creating various interference and locking features. The locking button system of the present invention involves the use of clasps and fasteners that rely on one or more pairs of flanges which apply opposing shearing forces to each other. These mechanisms can also include magnets or springs configured to bias the various parts into proper alignment. In some embodiments, magnets are preferable as they allow for the benefit of fewer points of failure for longer lifecycles. It will be appreciated that in some cases, the use of springs can be a reasonable substitute for magnets without requiring significant modifications to the designs.

The locking button system disclosed herein illustrates an elegant and compact clasp design which utilizes a keyed slot feature which is easy to engage and disengage using only one hand. Also, the execution of both engaging and releasing the locking button system is simple, intuitive and requires very little strength. However, when the clasp is engaged, because of the locking mechanisms involved, the coupling is stronger than the mere elastic properties of the interference fit between the various components, particularly in the primary tensile force direction therebetween.

It should be appreciated that the locking button system has a simplified workflow that allows the mechanism to be manipulated with one hand. Simply by placing two or more fingers against the sides of the top cap and rolling the fingertips by slightly curling the fingers they will rotate and create a lifting force under an exposed lip, thus causing the top cap to rise. This lifting force simply overcomes a magnetic attraction as there is no spring. Internally, this telescoping action releases a locking mechanism as the cap rises so as to allow for disengagement.

Figure 1:
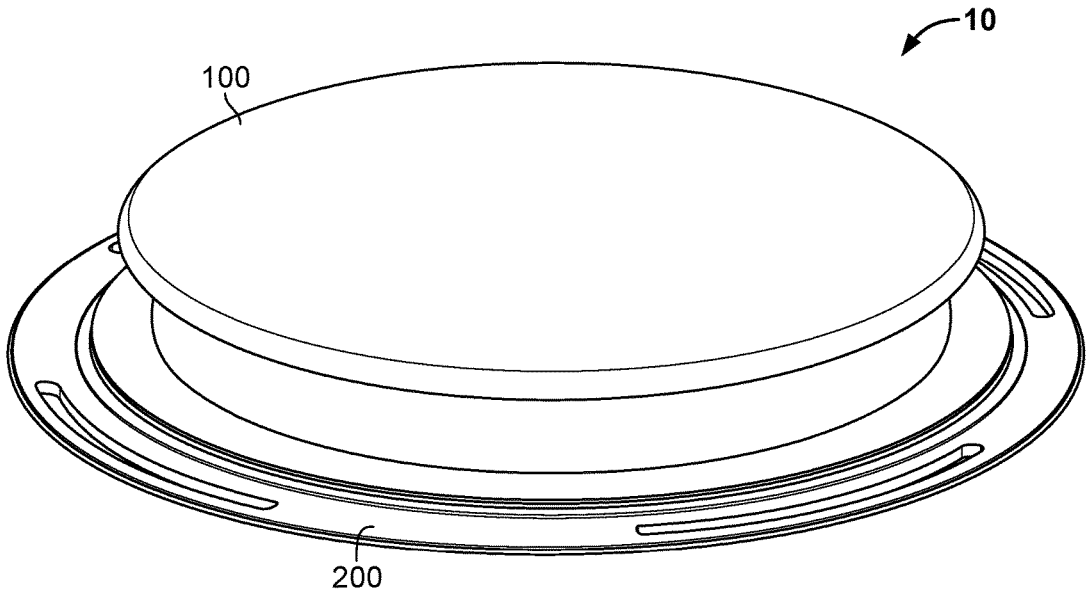
FIG. 1 illustrates a top perspective view of a locking button system illustrating various aspects of the present invention.

FIG. 1 illustrates a locking button system 10 in accordance with various aspects of the present invention. The locking button system 10 includes a female component 100 which in this case is visible on an exterior surface after the locking button system 10 is engaged. The locking button system 10 also includes a male component 200 which as shown can be connected to an interior surface or lower layer to form a clasping point, such as to close a jacket.

Figure 2:
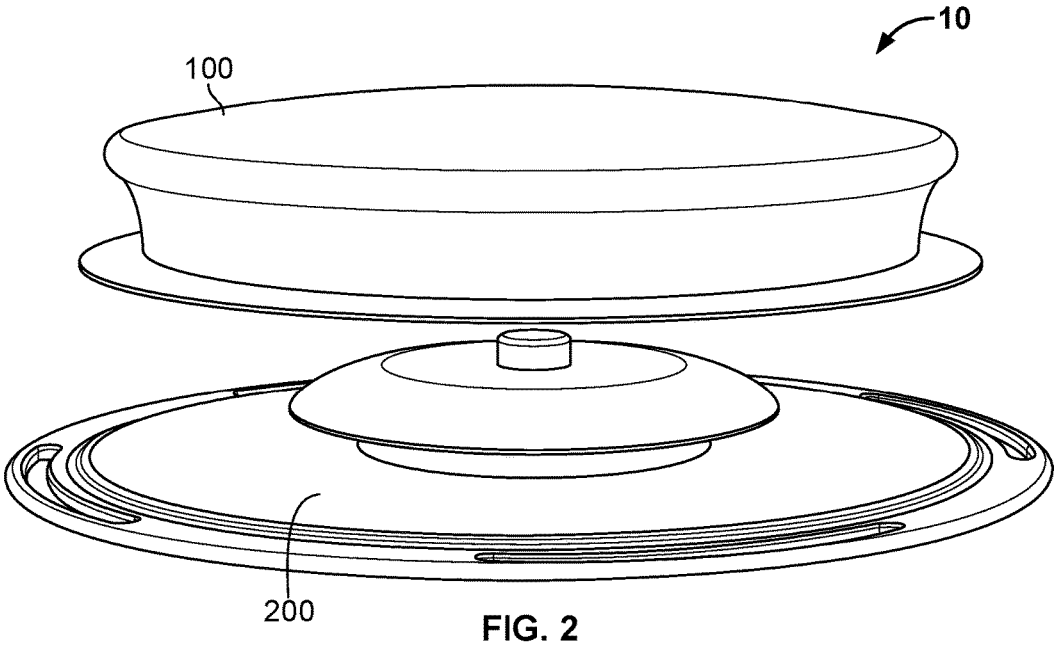
FIG. 2 illustrates a separated side perspective view of the locking button system of FIG. 1.

FIG. 2 illustrates a separated view of the locking button system 10 wherein the female component 100 is separated from the male component 200. It will be appreciated that a base portion of the male component can have various attachment means for affixing a base of the male component 200 to a desired attachment point on the specific article of clothing. For example, various apertures for stitching can be provided, or alternatively a rivet style system can be provided into the rear surface, or the male component can be adhered using an adhesive, as such it will be appreciated that numerous attachment means would be readily apparent to those having skill in the art, which alternatives fall within the scope of the present invention.

Figure 3A:
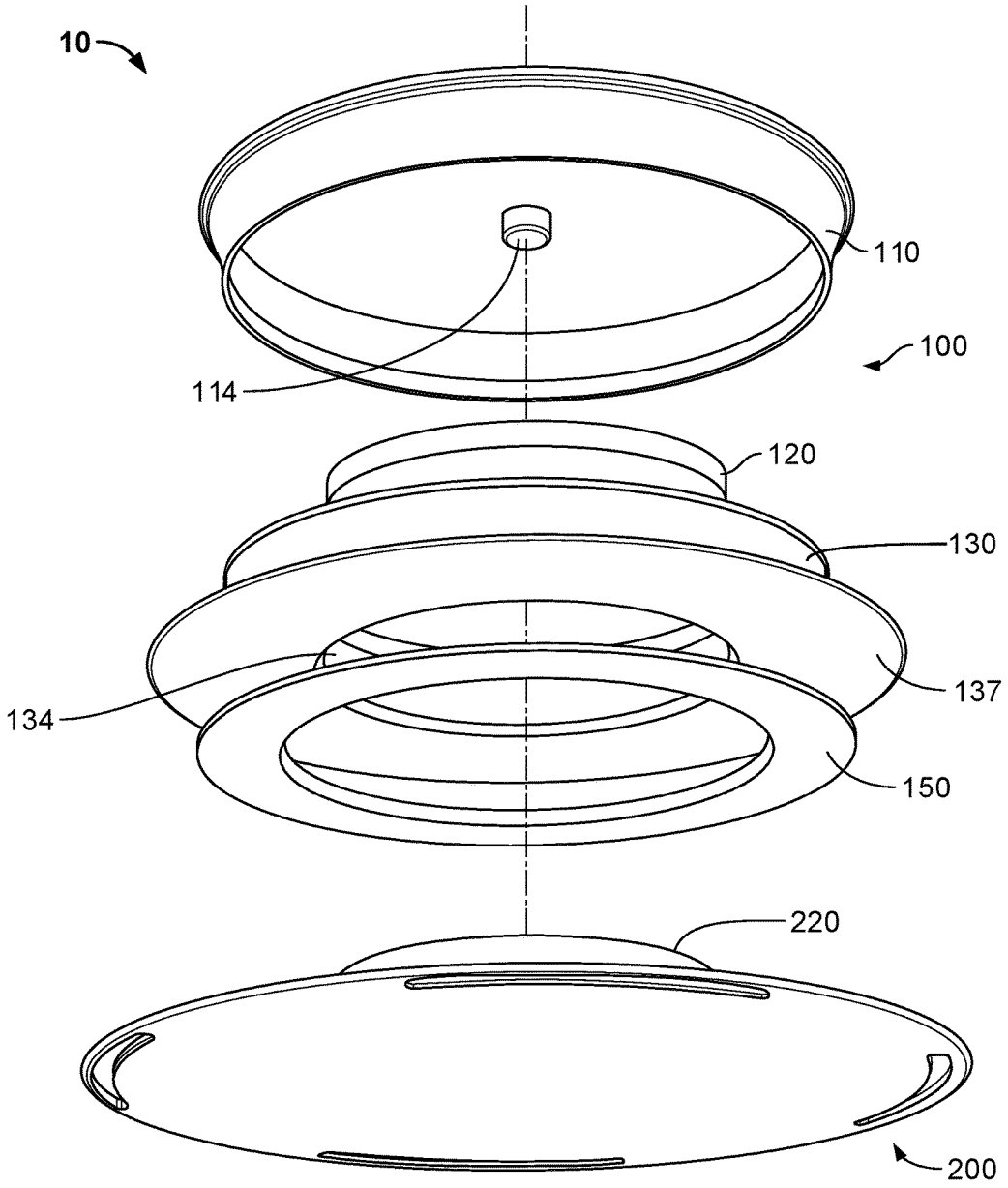
FIGS. 3A-B illustrate exploded top and bottom perspective views of the locking button system of FIG. 1.
Figure 3B:
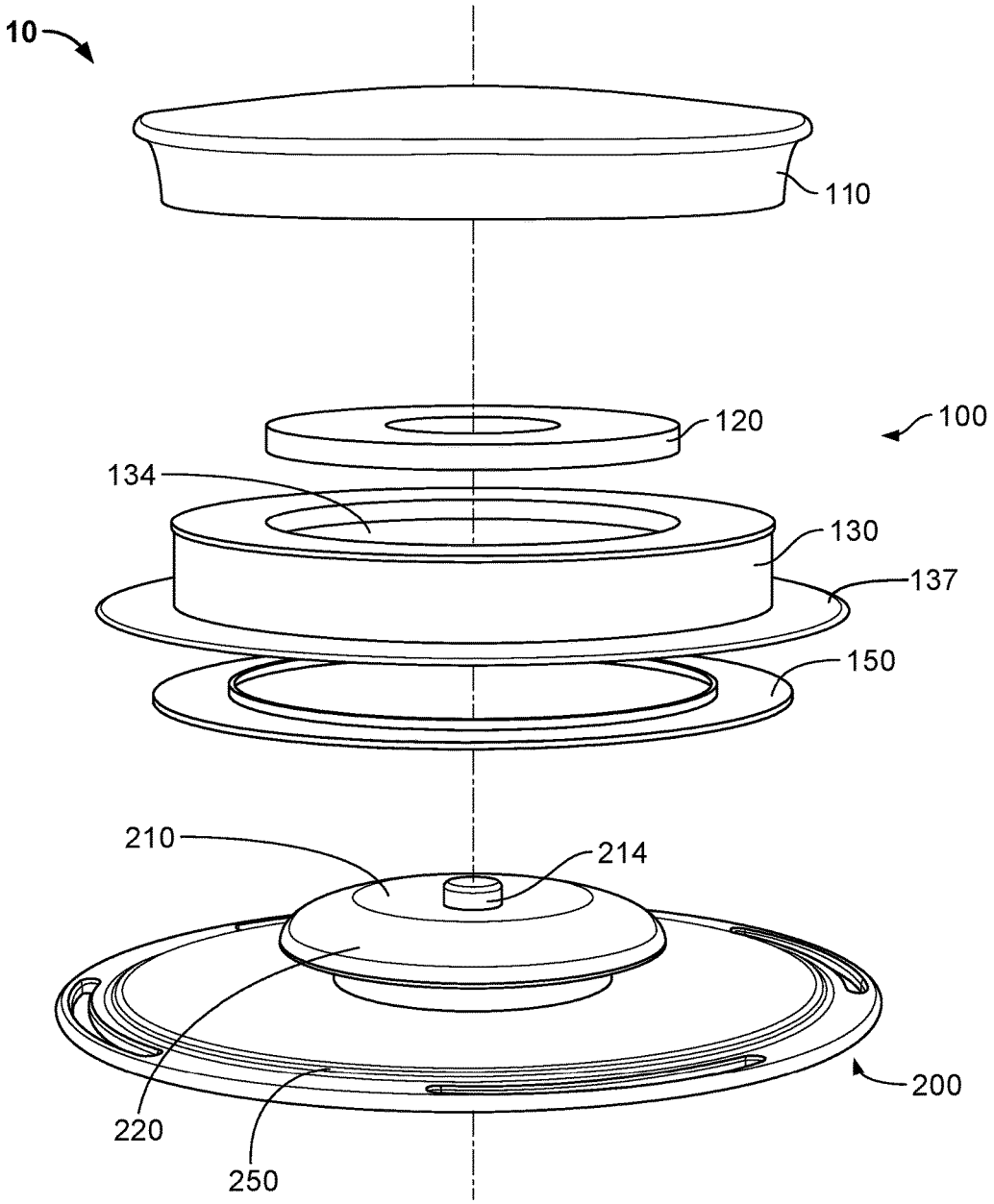

FIGS. 3A-B illustrate various exploded side perspective views of the locking button system 10 so as to illustrate various components in the male and female components 200 and 100 respectively, and more particularly, female component 100. The female component 100 includes a cap 110 which engages with an exterior sliding surface of a retention ring 130. The cap can be configured to telescope with respect to the retention ring. This telescoping movement can be limited by providing interfering lips or flanges 118 and 138 about the cap 110 and the retaining ring 130 respectively. The interfering lip 138 can be provided about a distal edge of the retaining ring, and the interfering lip 118 can be provided about a bottom edge of the cap such that they only engage in a maximum expanded configuration.

The retention ring 130 can be provided with a magnet 120 at an upper portion so as to bias the cap into a compressed configuration. The compressed configuration and the biasing into such a configuration will be discussed in greater detail below, as it aids in a locking step and configuration between the male and female components.

It will be appreciated that the female portion can also be provided with an anchor means such as a fabric retainer 150 at a lower portion. It will be appreciated that while the fabric retainer 150 is shown here as a crimp which sandwiches a portion of fabric 300A between the fabric retainer 150 and an outer flange 137 or the retention ring 130, that it can also be affixed through adhesion, as discussed above, or otherwise provided with holes through outer flange 137 or other attachment means which can be utilized for stitching, such alternative mechanisms will be readily apparent to those having skill in the art.

The retention ring 130 can be annular in shape with an open central portion along the axis for receiving a protrusion 210 of the female component 200. The protrusion 210 can include a flange portion 220 which can interact with the retention ring 130, particularly when slid radially into a channel or annular groove 134 of the retention ring 130. As such, the interior surface of the open central portion of the retention ring 130 can receive a portion of the flange portion 220 of the protrusion 210 of the male component 200 such that they interfere with one another and prevent axial relative translation between the male and female components when engaged.

It will be appreciated that a base portion 250 of the male component 200 can include the attachment means discussed above for affixing the male component to the fabric at an attachment point.

The locking button system 10 can also include first and second locking components, shown herein as locking pins 114 and 214 which will interact with each other as well as in conjunction with the magnet 120 so as to provide a locking mechanism which will be discussed in more detail below.

In order to affix the female component 100 to an opposing fabric, end of a strap, or at a specified point, the fabric retainer 150 can be crimped or otherwise pressed into the retainer ring 130 so as to sandwich a portion of fabric therebetween so as to facilitate proper positioning.

Figure 4:
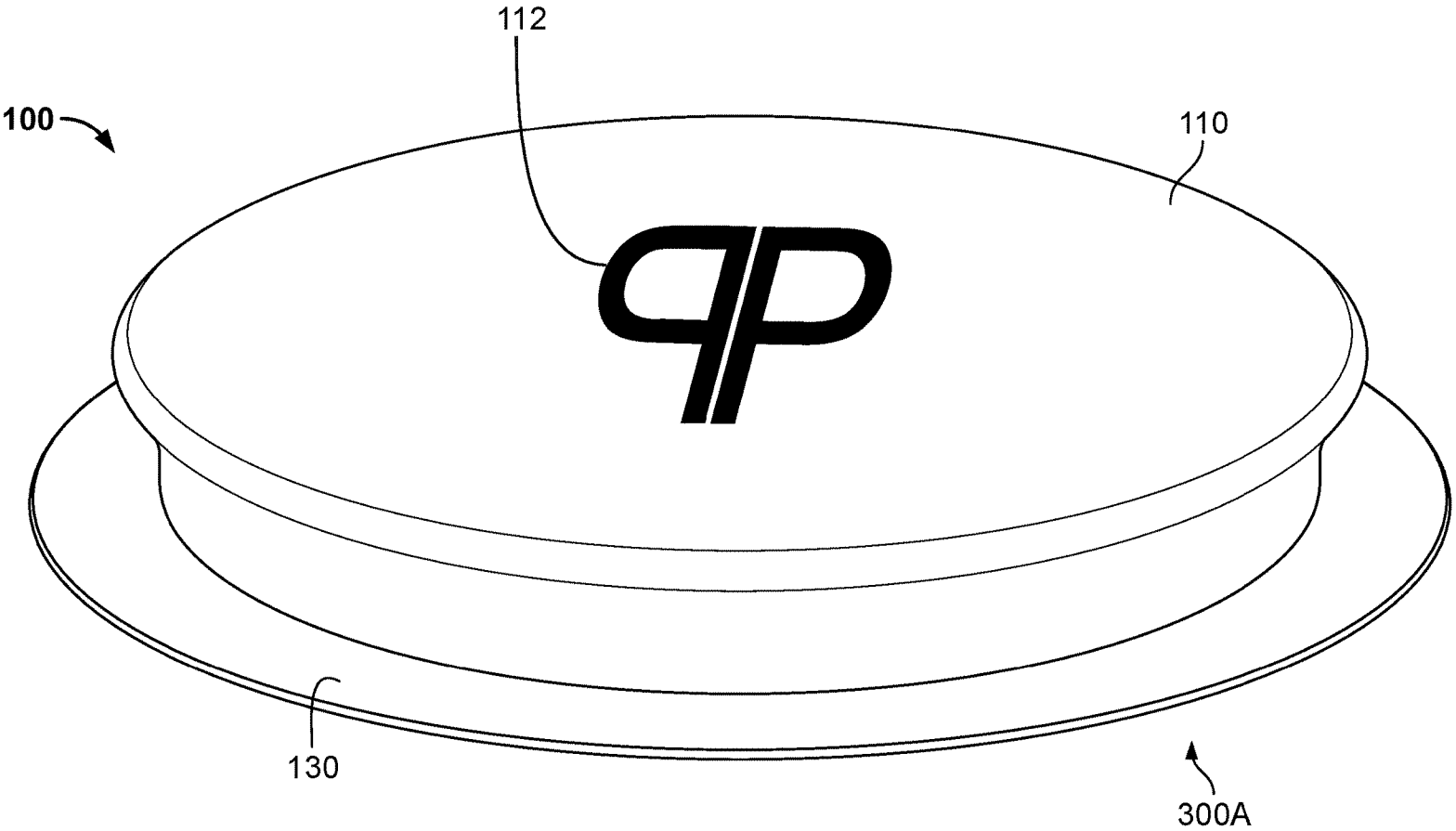
FIG. 4 illustrates a top perspective view of a female component for use in the locking button system of FIG. 1.

FIG. 4 illustrates an assembled female component affixed to a piece of fabric 300A wherein only the visible cap 110 and a bottom flange of the retainer ring 130 is visible. These two components can be plated, or formed of similar or differing materials so as to achieve virtually any desired aesthetic effect.

Figure 5A:
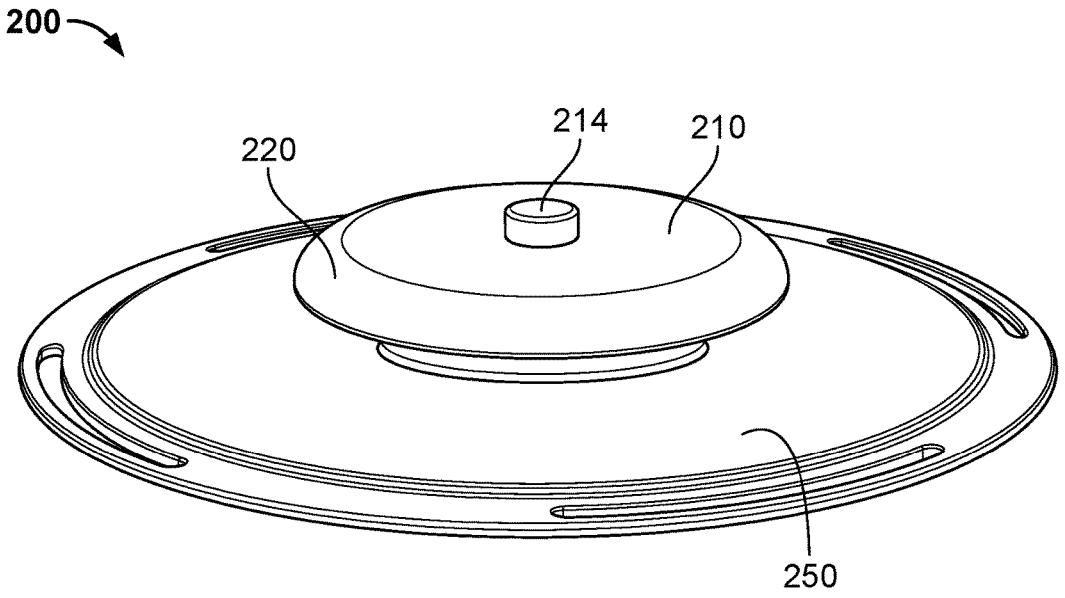
FIGS. 5A-B illustrate various top perspective views of a male component for use in the locking button system of FIG. 1.
Figure 5B:
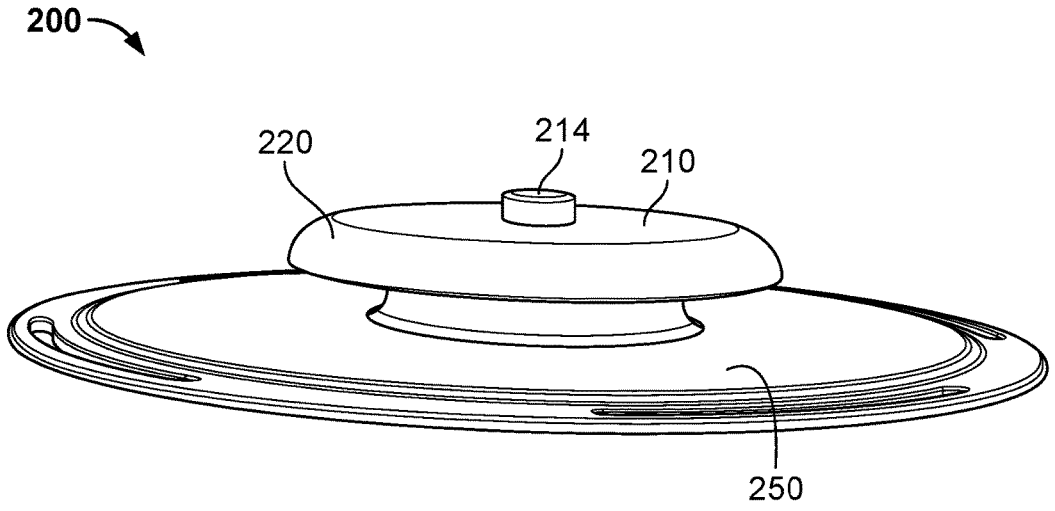

FIGS. 5A-B illustrate various side perspective views of the male component 200 which includes the base, for affixing to an attachment point, as well as the male protrusion 210 which includes the flange portion 220 and the locking pin 214.

Figure 6A:
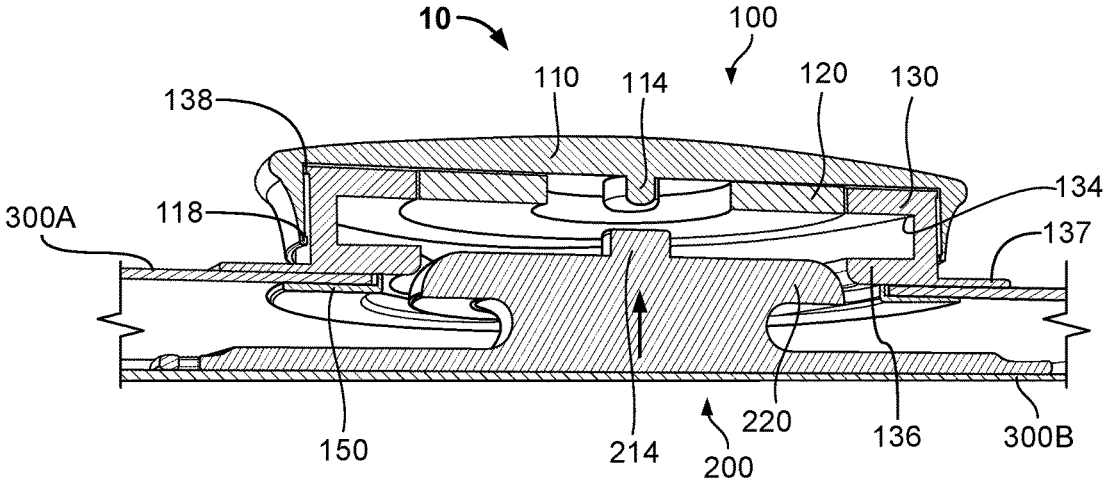
FIGS. 6A-D illustrate various cross sectional views of the locking button system of FIG. 1 and in particular the interaction between the male and female button components through various engagement steps.

FIGS. 6A-D and FIGS. 7A-D illustrate various steps in the coupling process of the locking button system 10 between the male component 200 and the female component 100 wherein the male component is affixed to a connection point on first fabric flap 300B and a connection point on second fabric flap 300A. FIG. 6A illustrates how initially male component and locking pin 214 is aligned coaxially with the female component 100 and locking pin 114. The male component 200 including the protrusion 210 and flange portions 220 fit into and slide into the internal cavity of the retention ring 130 until the locking pin 214 of the male component abuts the locking protrusion 114 of the female component 100.

Figure 6B:
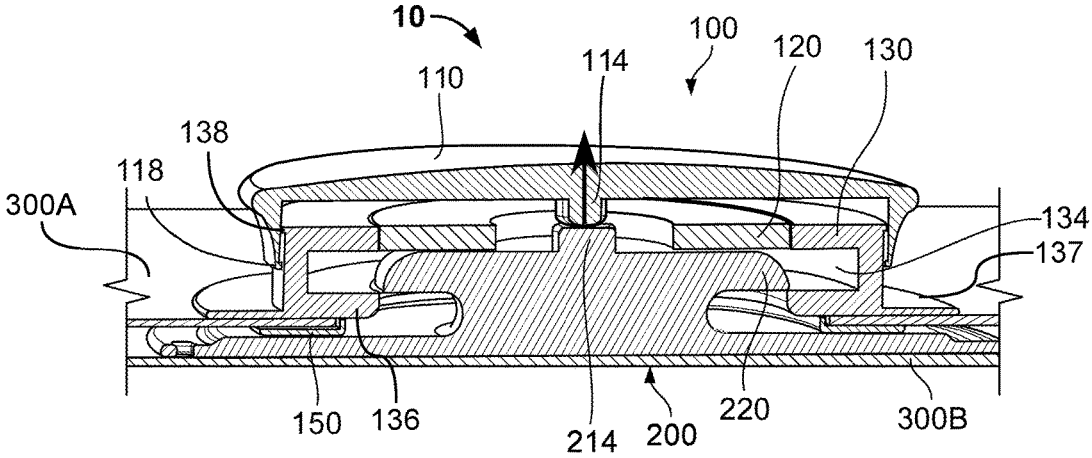

As shown in FIG. 6B, the male component pushes the cap 110 upward with respect to the retention ring 130 so as to allow for axial translation of the male component until the flange portion 220 aligns with the channel or annular slot 134.

Once the flange portion 220 is aligned with the annular slot 134 the male component 200 can be slid radially such that a portion of the flange portion 220 engages with a lower sidewall of the annular slot 134. This lateral movement causes the circular flange portion 220 to create a crescent-shaped engagement area with the lower sidewall of the annular slot 134. As such, at this point separation due to tensile stresses is impossible because of this engaged area.

Figure 6C:
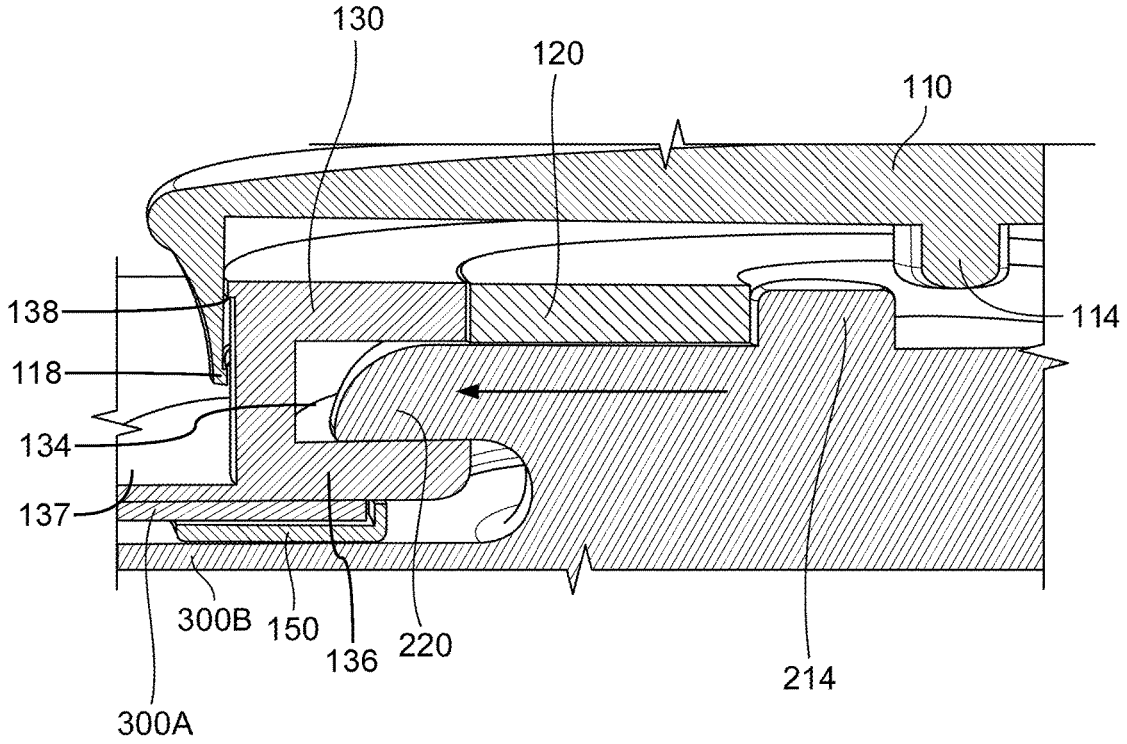
Figure 6D:
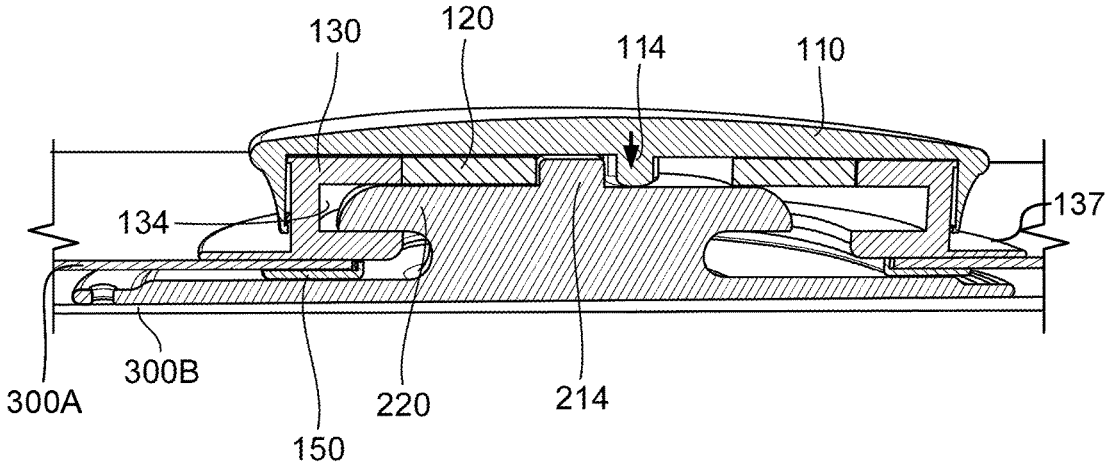
Figures 7A, 7B, 7C, 7D:
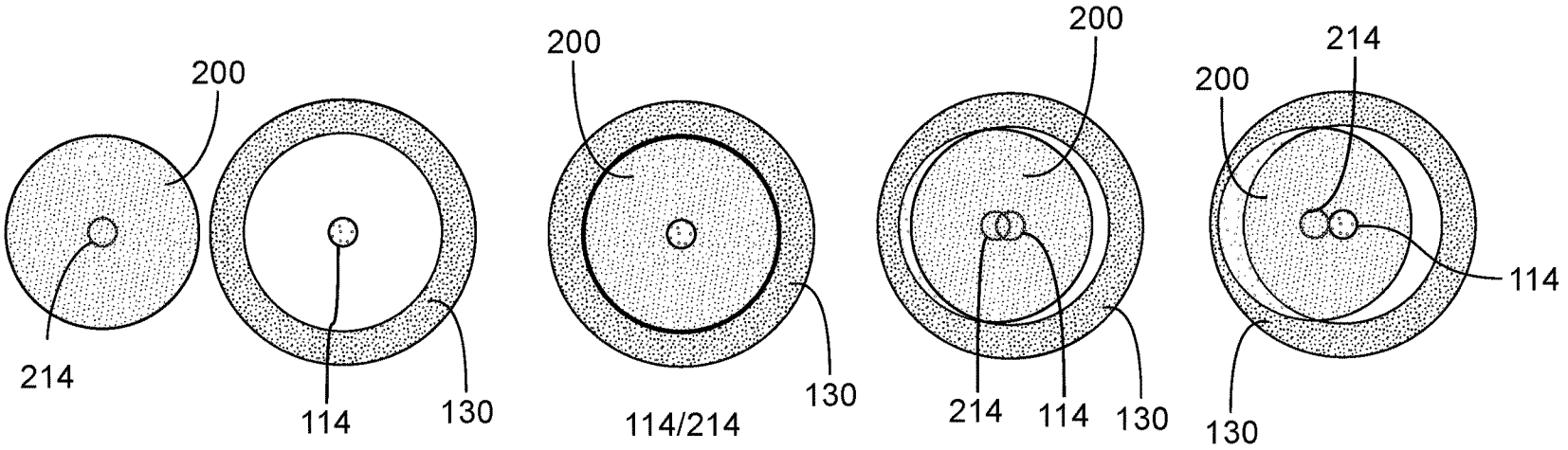
FIGS. 7A-D illustrate various top conceptual views of the interaction between the male and female components through various engagement steps.
Figure 8A:
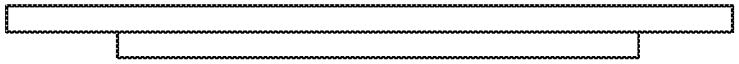
FIGS. 8A-D illustrate various engagement and disengagement angles between the male and female components through various steps.
Figure 8B:
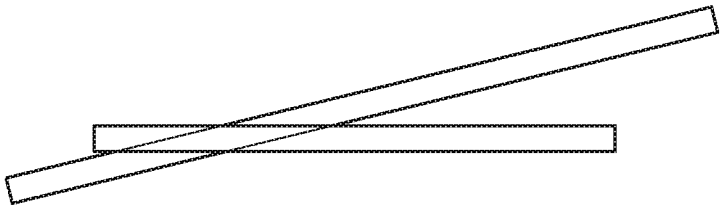
Figure 8C:
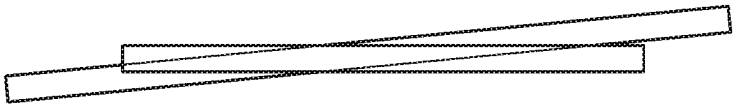
Figure 8D:
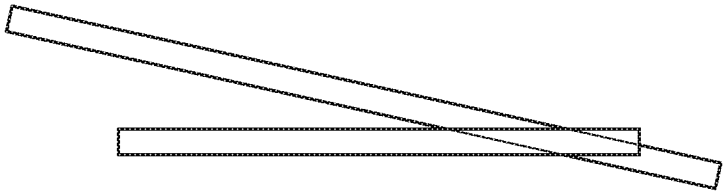

The lateral radial translation also allows for sufficient radial motion that the locking pin 114 is no longer stopped in the downward axial direction by the male locking pin 214 as shown in FIGS. 6C-D and the locking pin 114 and visible cap are allowed to translate axially downward and the locking pin slides to align radially with the male locking pin 214 preventing radial translation back with into axial alignment between the flange portion and the interior aperture of the retention ring 130. Structurally, the locking pins function solely as locking mechanisms and do not bear any of the fastening stresses that occur laterally. The pins simply prevent incidental alignment during times when tension goes to zero, as such alignment could cause the clasp to disengage. The pins insure that the clasp always maintains that crescent-shaped meshing of the crescent-shaped engagement area.

Figure 9:
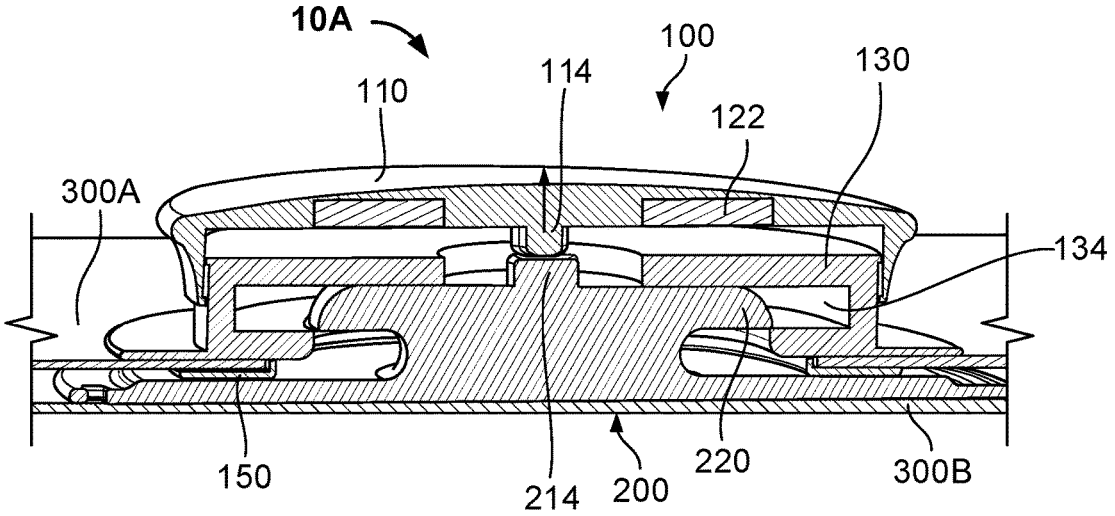
FIG. 9 illustrates a side cross sectional view of a locking button system having an alternative magnet configuration.
Figure 10:
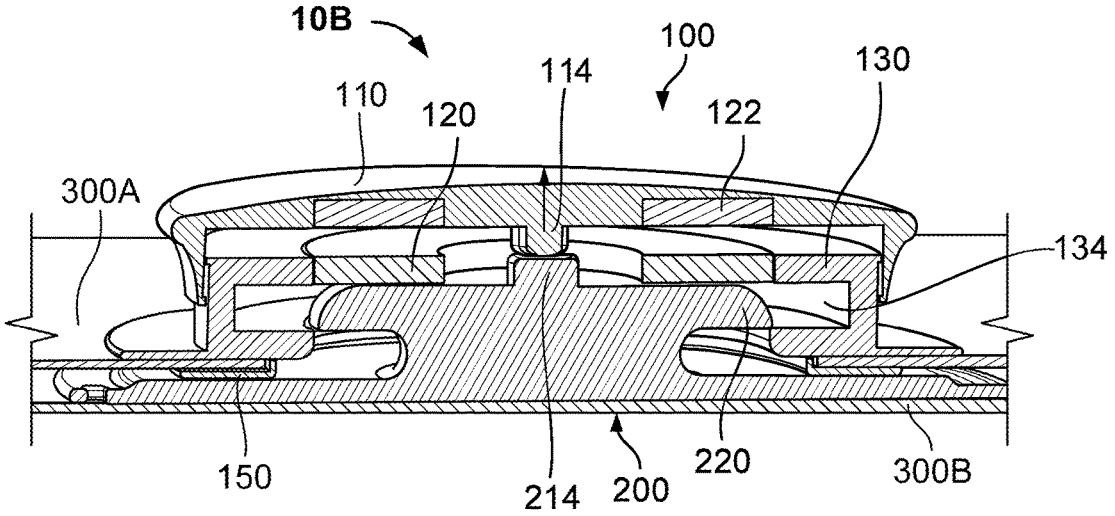
FIG. 10 illustrates a side cross sectional view of a locking button system having yet another alternative magnet configuration.
Figure 11:
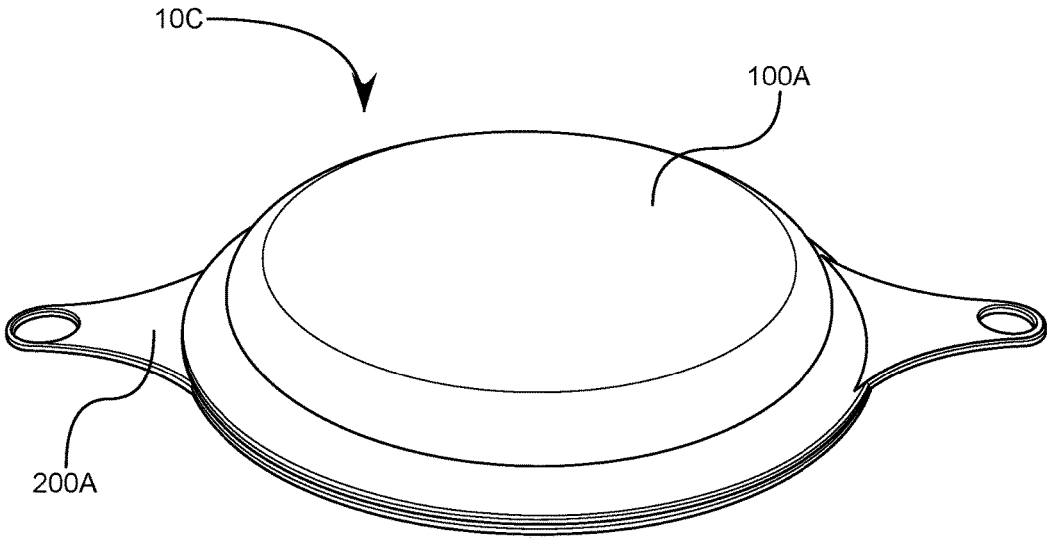
FIG. 11 illustrates a top perspective view of an alternative embodiment of a locking button system illustrative of various alternative attachment means.
Figure 12:
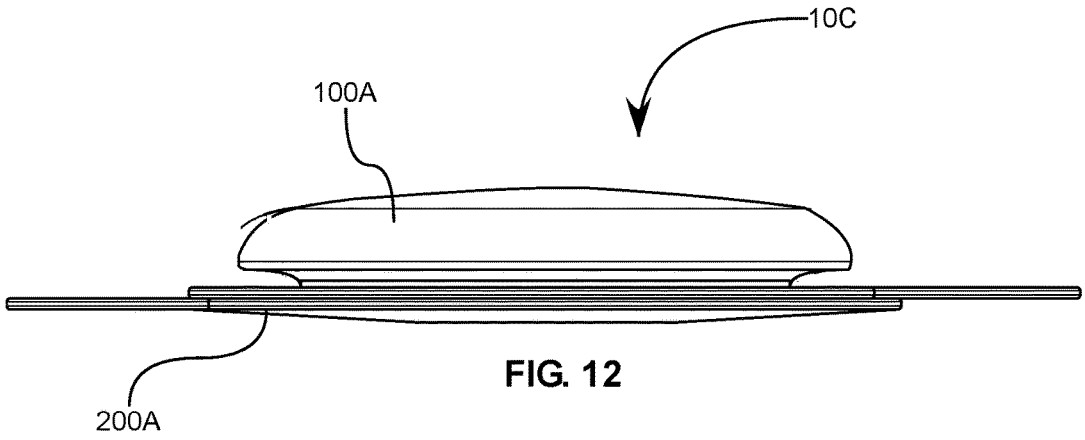
FIG. 12 illustrates a side view of the locking button system as illustrated in FIG. 11.
Figure 13:
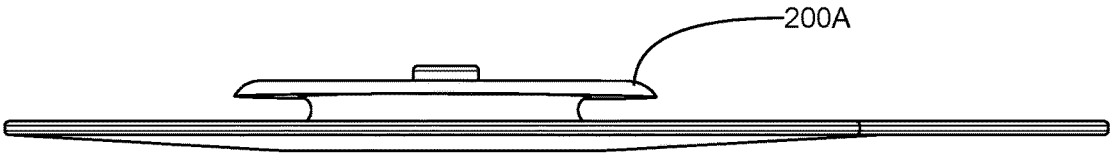
FIG. 13 illustrates a side view of an alternative male component of the system as illustrated in FIG. 11.
Figure 14:
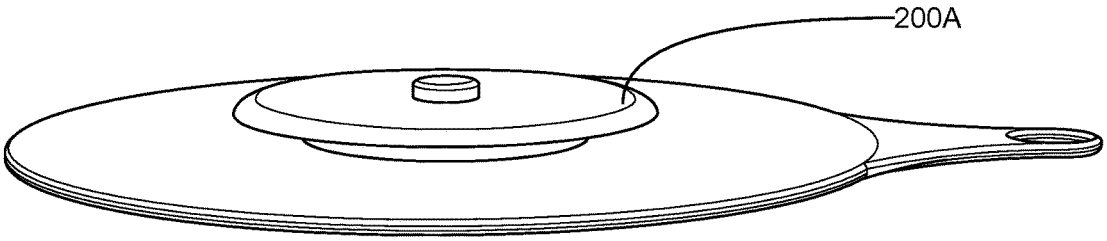
FIG. 14 illustrates a side perspective view of an alternative male component of the system as illustrated in FIG. 11.
Figure 15:
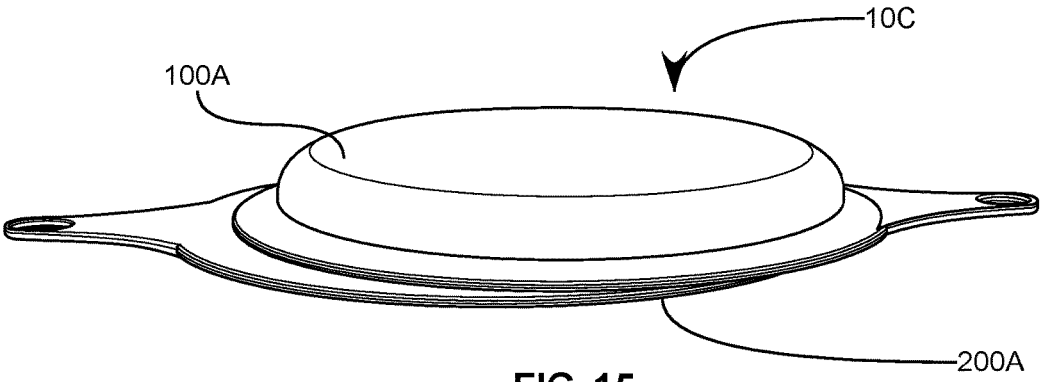
FIG. 15 illustrates a side perspective view of the locking button system as illustrated in FIG. 11 and FIG. 13 in a locked configuration.
Figure 16:
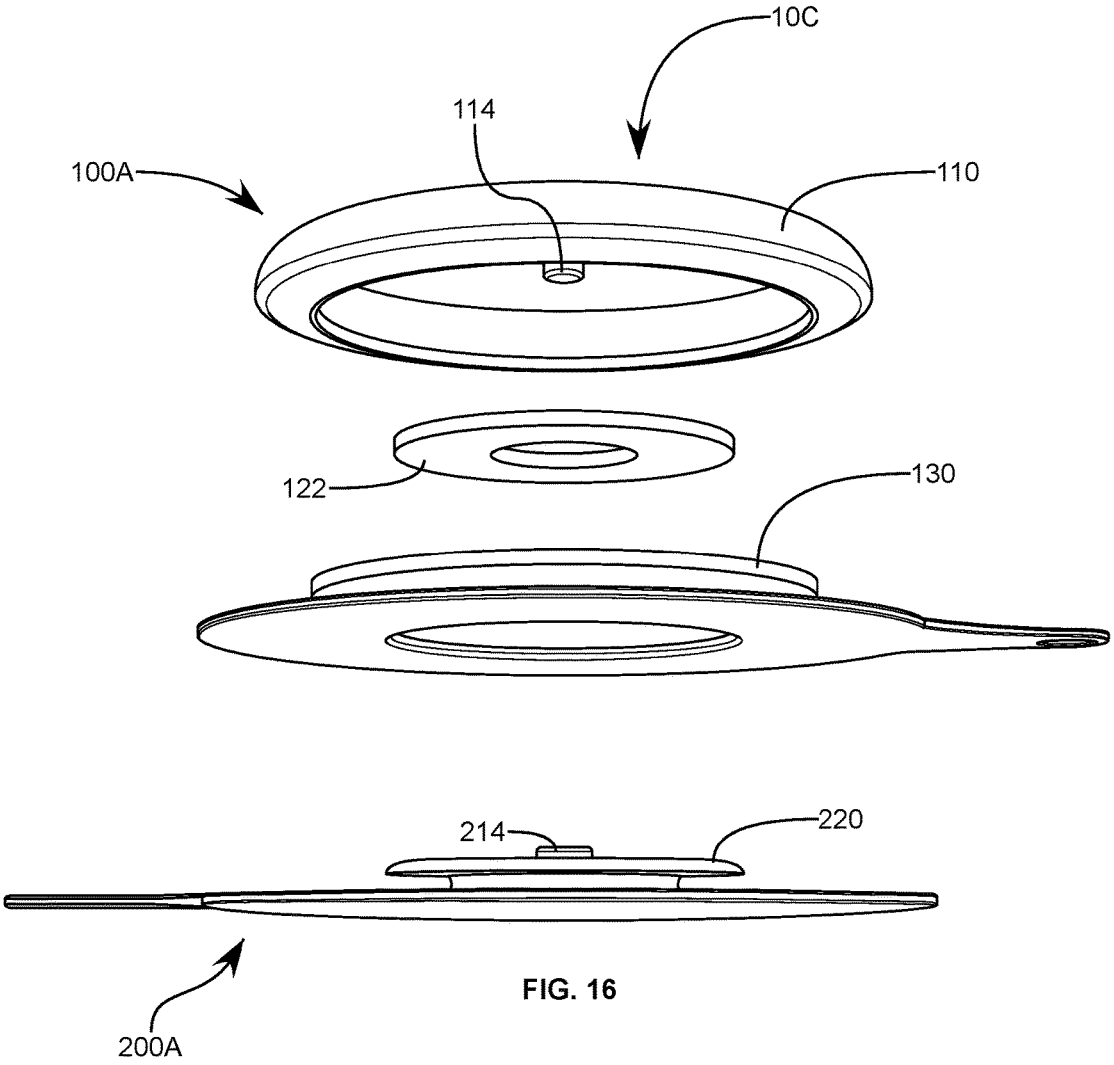
FIG. 16 illustrates a side exploded perspective view of the locking button system as illustrated in FIG. 11 and FIG. 13.
Figure 17:
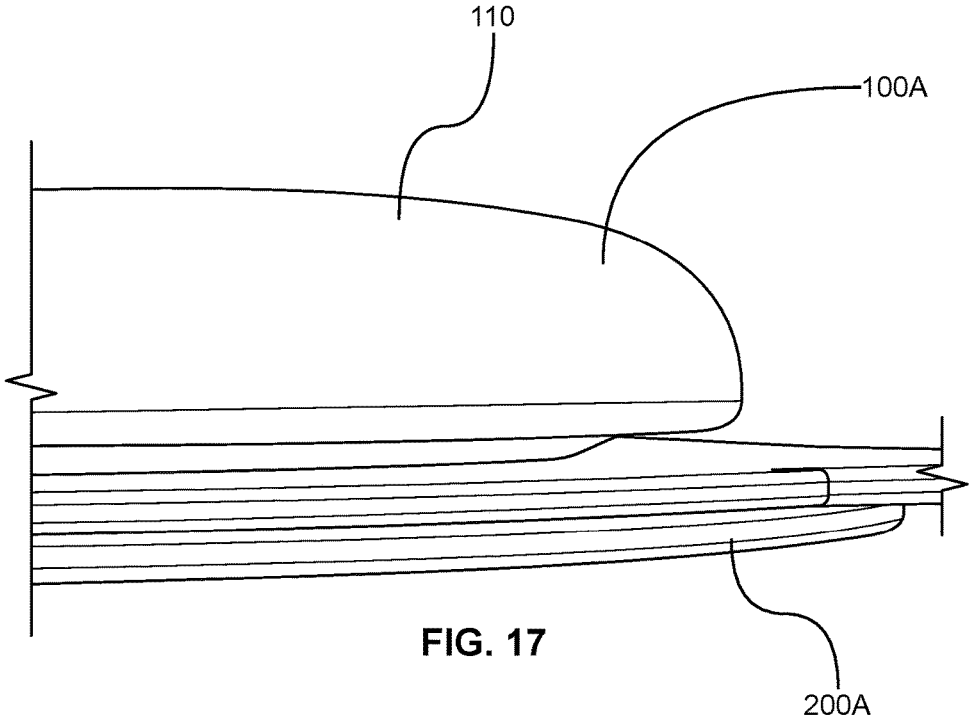
FIG. 17 illustrates a side detailed perspective view of the locking button system as illustrated in FIG. 15.
Figure 18:
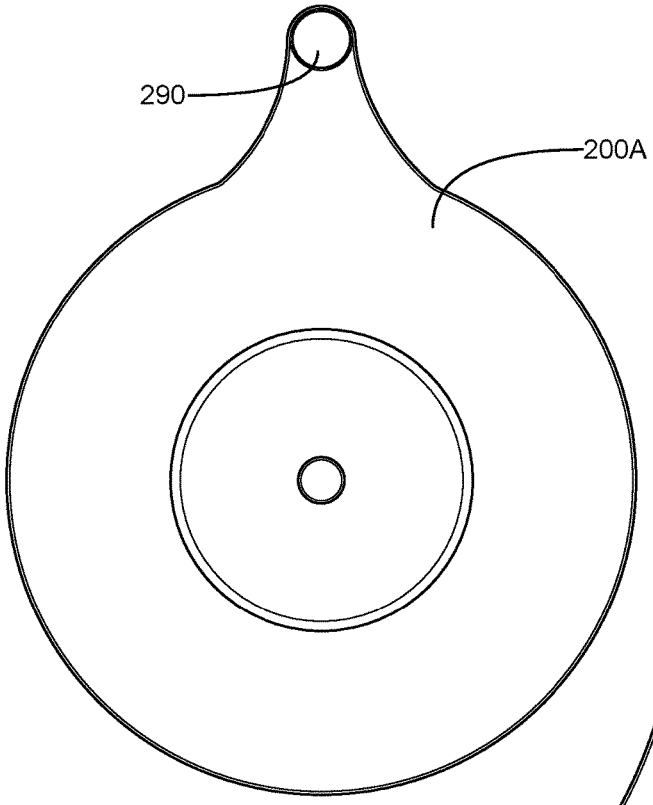
FIG. 18 illustrates a top view of an alternative male component applicable for use in any of a locking button systems shown above.

The magnet 120 which can be press fit, bonded, or otherwise provided on the upper surface of the retention ring 130 can then act to retain the visible portion 110 in the axial downward position until release is desired by the user. It will be appreciated that the cap 110 can be formed of a corresponding ferromagnetic material, or even be provided with a corresponding magnet 120B on its interior surface, as shown in FIG. 10, so as to increase the magnetic coupling strength between the visible portion 110 and the retention ring so as to maintain the radial positioning of the locking pin 114 behind the male locking pin portion. In some embodiments, the male component can also be ferrous and thus be attracted to a magnet embedded in an interior surface of the cap, as shown in FIG. 9.

It will be appreciated that these arrangements then provide a compressive force between the male portion and the cap, and particularly between the retention ring 130 and the cap so as to cause the pin 114 of the cap to interfere with the radial translation of the second locking pin 214 after the male portion is slid radially into the retention ring 130 and its channel or cavity 134.

In other words, this attraction applies a downward force on the female annular ring, working to discourage any separation of the male and female components because the male portion will then be unable to translate radially to align the axis of the circular flange portion with the aperture in the retention ring because of the interfering pins 114 and 214.

The downward pull of the magnet also plays a role as it aids the user in initial engagement since the button will try to engage when it gets close enough so as to be within the effect of the magnetic field.

In this manner, the male component 200 can move within the slot in a circle about the axis, but will be prevented from moving radially inward and allowing for unlocking of the male component 200 from the female component 100.

In yet additional embodiments it would also be possible to embed an additional ring magnet in the top of the male surface so as to strengthen the magnetic attraction.

Additionally, because the interference area between the flange portion 220 and the annular slot 134 is a crescent-shaped engagement two-dimensional planar area the components can thus resist rotating out of axial parallel alignment, and thus prevent a unlocking under an out of axis torque load.

FIGS. 8A-D, as discussed above illustrate that the male and female components can be engaged from various angles so as to establish a connection or to disengage a previously established connection. Note that while increasing the amount of play between the two components will often make it possible to affect how easy it is to transition to engaged, there will be an inflection point, i.e. a maximum angle, beyond which some stages may get harder. Also, it should be noted that the components can pass each other through the various stages if they are at an angle to each other with varying difficulty, in this manner perfect alignment is not necessarily required for purposes of engagement or disengagement. However, in practice a maximum relative angle of about 20 degrees appears to be most comfortable and useful.

As such, the present invention as contemplated herein can include a locking button system 10, the system having a male component 200 having a male flange portion 220, the male component 200 further including a first locking component 214, in the form of a pin, being provided on an upper surface of the male component 200. The male component 200 being configured to interact with a female component 100, the female component 100 including an annular retention ring 130 defining an interior cavity or channel 134 provided therein on an interior surface of the annular retention ring, the annular retention ring 130 having a female flange portion 136 having an inner diameter corresponding to an outer circumference of the male flange portion 220 of the male component 200.

A cap 110 can then be provided over the annular retention ring 130 wherein a second locking component 114 can be provided on an interior surface of the cap 110, the second locking component 114 being configured to engage the first locking component 214 of the male component 200.

In some embodiments, a magnet 120 can be provided about an upper surface of the annular retention ring 130. It will also be appreciated that the magnet 120 can be embedded into an upper surface of the retention ring 130 such that the magnet 120 and the retention ring 130 have a flush or smooth upper surface. In an alternative embodiment, an alternative magnet 120B, as shown in FIG. 10, can be provided about an interior surface of the cap 110 wherein the annular retention ring is formed of a magnetically responsive material such that the magnet and the cap are biased in a compressed configuration, or configured such that the cap and the magnet tend to draw together.

It will also be appreciated that in some embodiments the male component can include a base portion having an anchor means 250 which can then be configured to attach to a first closing component, i.e. a first end of a strap. Further, in some embodiments the female component can also include a base portion having an anchor means 150 configured to attach to a second closing component, i.e. a second end of a strap, such that two ends of a strap can be affixed together.

Also contemplated herein is a method for coupling a male component of a locking button system to a female component of locking button system, the method including the steps of: providing a male component having a male flange portion and a male locking pin provided on an upper surface of the male component; providing a female component, the female component having: an annular retention ring defining an interior cavity, the annular retention ring having an interior groove provided on the interior surface, the interior cavity having a diameter corresponding to an outer circumference of the flange portion of the male component; an axially telescoping cap; and a second locking pin provided on an interior surface of the axially telescoping cap; inserting the male component into the female component translating the male component axially until the male locking pin abuts against the second locking pin and thus causing the axially telescoping cap to translate axially; translating the male component radially outward causing the male flange portion to engage a sidewall of the interior groove; translating the axially telescoping cap so as to cause the second locking pin to interfere with radial translation of the male locking pin of the male component.

The method contemplated above can alternatively include the steps of providing a magnet on an upper surface of the annular retention ring; and forming the axially telescoping cap of a magnetically responsive material.

In yet another alternative embodiment, the method contemplated above can include the steps of: providing a magnet on an upper surface of the annular retention ring; and providing a corresponding magnet on an interior surface of the axially telescoping cap.

In some such alternative embodiments, the method can include a step of embedding magnet into a recess provided about an upper flange of the annular retainer ring such that an upper surface of the magnet is flush with the upper surface of the annular retainer ring.

In yet another alternative embodiment, the method contemplated above can include the steps of: providing a magnet on an upper surface of the annular retention ring; and providing an additional magnet on an interior surface of the axially telescoping cap.

In yet another alternative embodiment, the method contemplated above can include the steps of: embedding a magnet within an upper surface of the annular retention ring; and providing an additional magnet on an interior surface of the axially telescoping cap.

In yet another alternative embodiment, the method contemplated above can include the steps of: providing a magnet on an inner surface of the axially telescoping cap; and forming the annular retention ring of a magnetically responsive material.

FIGS. 11-18 illustrate various aspects an alternative locking button system having male and female locking components 100A and 200A respectively. These components lock together in the same manner as the embodiments described above with retaining ring 130, flange portion 220 and are attracted together using magnet 122 and locked using locking pins 114 and 214 respectively. This embodiment does however vary in that the attachment means is provided as a circular aperture 290 which can be configured to connect to a chain or a rope.

Figure 19:
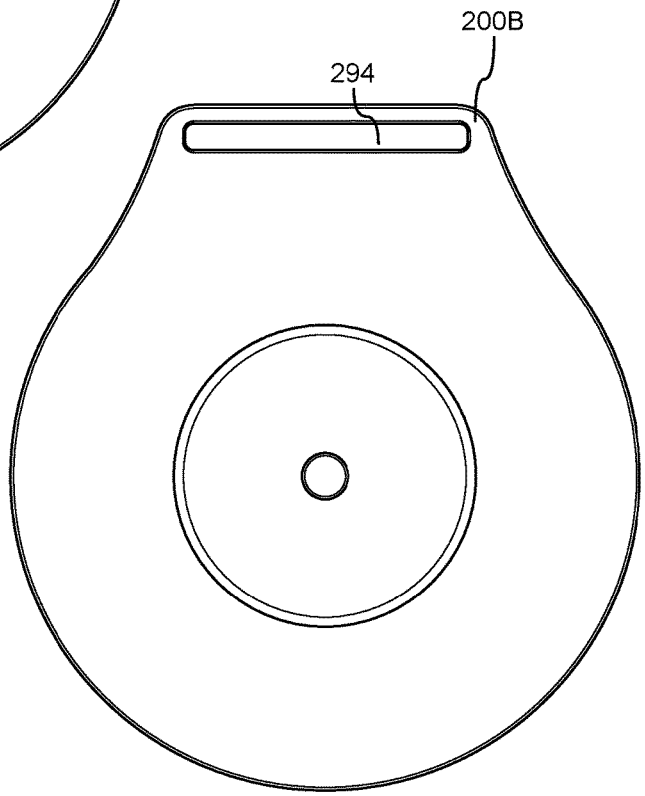
FIG. 19 illustrates a top view of an alternative male component applicable for use in any of a locking button systems shown above.

FIG. 19 illustrates an alternative male locking component 200B which has yet another alternative attachment means in the shape of an elongated aperture 294, wherein the elongated aperture is more suitable for the receiving of flat straps, etc.

It will also be appreciated that the top surface of the cap 110, in any of the aforementioned embodiments can be provided with one or more features, such as indicia 112. In some embodiments, the top surface can be provided with a coating of tactile material, such as rubber or silicone, so as to improve the ease of grasping the cap 110 by a user. It will be appreciated that the magnets embedded within the locking button system can greatly increase the ease of single-hand clasping functions or aide in ease of alignment for users having decreased motor function, such as the elderly or those with debilitating diseases such as ALS, etc.

In yet alternative embodiments the indicia 112 can be provided instead as decorations which increase the aesthetic properties, such as gems, jewels, cameos, or other jewelry such that the button itself can become or resemble a pendant or the focal piece of the item, such as a necklace.

While several embodiments have been described herein that are exemplary of the present invention, one skilled in the art will recognize additional embodiments within the spirit and scope of the invention. Modification and variations can be made to the disclosed embodiments without departing from the scope of the disclosure. Those skilled in the art will appreciate that the applications of the embodiments disclosed herein are varied. Accordingly, additions and modifications can be made without departing from the principles of the disclosure. In this regard, it is intended that such changes would still fall within the scope of the disclosure. Therefore, this disclosure is not limited to the particular embodiment as shown, but is intended to cover modifications within the spirit and scope of the disclosure.

What is claimed is:

1. A locking button system, the system comprising:

a male component having a male flange portion, the male component further including a first locking component being provided on an upper surface of the male component;

a female component, the female component further comprising:

an annular retention ring defining an interior channel provided on an interior surface of the annular retention ring, the annular retention ring having a female flange portion having an inner diameter corresponding to an outer circumference of the male flange portion of the male component;

a cap being provided over the annular retention ring; and a second locking component provided on an interior surface of the cap, the second locking component being configured to engage the first locking component of the male component.

2. The locking button system of claim 1, further comprising:

a magnet provided about an upper surface of the annular retention ring; and wherein the cap is formed of a magnetically responsive material.

3. The locking button system of claim 1, further comprising:

a magnet provided on an upper surface of the annular retention ring;

wherein the cap includes a corresponding magnet on an interior surface.

4. The locking button system of claim 1, further comprising:

a magnet provided about an interior surface of the cap;

wherein the annular retention ring is formed of a magnetically responsive material.

5. The locking button system of claim 1, wherein the male component includes a base portion having an anchor means configured to attach to a first closing component.

6. The locking button system of claim 1, wherein the female component includes a base portion having an anchor means configured to attach to a second closing component.

7. The locking button system of claim 2, wherein the magnet is provided within a recess of an upper flange of the annular retainer ring such that an upper surface of the magnet is flush with the upper surface of the annular retainer ring.

8. The locking button system of claim 2, wherein the magnet is provided with an aperture about a central portion thereof, wherein the aperture has a radius corresponding with a depth of the interior channel of the annular retention ring.

9. The locking button system of claim 1, wherein the cap further comprises an interior flange, and the annular retention ring further comprises an exterior flange, and wherein the cap is configured to translate axially with respect to the annular retention ring wherein the interior flange of the cap and the exterior flange of the annular retention ring interfereingly engage with one another in an extended state and limit travel in the axial direction.

10. A locking button system, the system comprising:

a male component having a male flange portion, the male component further including a first locking component being provided on an upper surface of the male component;

a female component, the female component further comprising:

an annular retention ring defining an interior cavity, the annular retention ring having an interior channel provided on an interior surface of the annular retention ring, the annular retention ring having a female flange portion having an inner diameter corresponding to an outer circumference of the male flange portion of the male component;

a cap being provided over the annular retention ring; and a second locking component provided on an interior surface of the cap, the second locking component being configured to engage the first locking component of the male component;

a magnet provided between the annular retention ring and the cap, the magnet being configured to bias the cap in a compressed configuration;

wherein the male component includes a base portion having an anchor means configured to attach to a first closing component; and wherein the female component includes a base portion having an anchor means configured to attach to a second closing component.

11. The locking button system of claim 10, wherein the magnet is provided with an aperture about a central portion thereof, wherein the aperture has a radius corresponding with a depth of the interior channel of the annular retention ring.

12. The locking button system of claim 10, wherein the cap further comprises an interior flange, and the annular retention ring further comprises an exterior flange, and wherein the cap is configured to translate axially with respect to the annular retention ring wherein the interior flange of the cap and the exterior flange of the annular retention ring interferingly engage with one another in an extended state and limit travel in the axial direction.

* * * * *